United States Patent [19]

Maiorano

[11] 4,120,579

[45] Oct. 17, 1978

[54] IMAGING SYSTEM FOR A PHOTOCOPYING DEVICE

[75] Inventor: Dominick J. Maiorano, West Webster, N.Y.

[73] Assignee: Xerox Corporation, Stamford, Conn.

[21] Appl. No.: 719,757

[22] Filed: Sep. 2, 1976

[51] Int. Cl.[2] ..... G03G 15/00

[52] U.S. Cl. ..... 355/11; 355/76

[58] Field of Search ..... 355/3 R, 8, 11, 75, 355/76

[56] References Cited

U.S. PATENT DOCUMENTS

| | | | |
|---|---|---|---|
| 2,970,514 | 2/1961 | Collins | 355/75 X |
| 3,062,110 | 11/1962 | Shepardson et al. | 355/11 |
| 3,497,296 | 2/1970 | Faw | 355/3 R |
| 3,788,737 | 1/1974 | Kidd | 355/7 X |
| 3,957,370 | 5/1976 | Vola | 355/75 X |
| 3,992,093 | 11/1976 | Jakobson | 355/8 X |
| 3,998,541 | 12/1976 | Michaloski | 355/3 R X |
| 4,008,956 | 2/1977 | Stemmle | 355/8 |

*Primary Examiner*—Fred L. Braun

[57] ABSTRACT

A photocopying machine wherein a reflected light pattern is projected along an optical path and on to a photoreceptor surface by moving a document supported on a transport belt past a stationary illumination source and reflecting mirror structure. The light pattern impinges on the photoreceptor in a predetermined area thereof, which is provided with a uniform electrostatic charge capable of being discharged in accordance with the light pattern. The present invention is characterized by the provision of a multi-faceted reflector which is supported to one side of a document carrying belt such that illumination from the source can be reflected along the optical path to thereby discharge the photoreceptor adjacent the area struck by the light pattern.

5 Claims, 5 Drawing Figures

IMAGING SYSTEM FOR A PHOTOCOPYING DEVICE

BACKGROUND OF THE INVENTION

This invention relates to the electrophotographic reproducing apparatus and more particularly to an exposure system therefor which includes means for moving the document past a stationary illumination exposure system.

One type of electrophotographic reproducing apparatus comprises a document transport belt which supports a document to be reproduced for movement past a stationary illumination source for flooding the document with light, which light is reflected in a predetermined pattern, in accordance with the image on the document to be reproduced. The light pattern impinges on a uniformly charged portion of a photoreceptor to effect discharge thereof whereby a latent electrostatic image is formed on the photoreceptor. The image is subsequently rendered visible through development with electroscopic marking particles commonly referred to as toner.

Another type of electrophotographic reproducing apparatus comprises a transparent platen for stationarily supporting a document to be reproduced, the document being flooded with illumination which is reflected as a light pattern along an optical path and impinges upon the photoreceptor. In this type of apparatus, the illumination source is moved relative to the document to thereby illuminate, in sequence, each portion of the document. In this manner, a light image is flowed on to the photoreceptor which is moved in synchronism with the movement of the illumination source. In order to prevent a dark border or edge being developed on the photoreceptor with subsequent transfer to the copy paper a diffuse reflector structure is normally provided behind the document and in contact therewith during document exposure. Portions of the reflector extend beyond the edges of the document and reflect illumination adjacent the edges of the document along the optical path and onto the photoreceptor to thereby discharge the photoreceptor adjacent the areas struck by the light pattern.

In an apparatus of the type herein contemplated, therefore, one having a stationary illumination source and means for moving a document therepast, the reflector would have to be spaced away from the document to permit the document to be moved relative to the illumination source. With such an arrangement the reflector irradiance, due to the spacing, is not adequate to prevent a dark border or edge appearing on the finished copy. Moreover, when the illumination has to pass through a document belt before it impinges on the reflector, the illumination is attenuated thereby adding to the problem of insufficient reflector irradiance.

It is the primary object of this invention to provide an improved imaging system for electrophotographic reproducing apparatus wherein the document is moved past a fixed exposure station.

BRIEF SUMMARY AND OBJECTS OF THE INVENTION

Briefly, the objects of the present invention are accomplished by the provision, in an electrophotographic reproducing apparatus, a transparent belt which is adapted to support a plurality of documents to be reproduced while moving the documents in sequence past a stationary illumination and image projection system to project the image along an optical path which terminates at a photoreceptor which has been uniformly charged. As the documents are moved past the illumination station, a light pattern is reflected from the document along the optical path and impinges on the photoreceptor in the uniformly charged area thereby discharging the photoreceptor in accordance with the light pattern projected.

A multi-faceted edge fadeout reflector is supported adjacent the side of the transparent belt opposite to the side thereof which supports the documents to be reproduced. It will be appreciated that as the document is moved by the belt and in a position to block the reflector from illumination, the illumination will be reflected by the document alone. However, the document does not fully cover the refector illumination from the source which passes through the belt and impinges on the reflector is reflected back through the belt and along the optical path in the direction of the photoreceptor. This illumination impinges on the photoreceptor in an area adjacent the area struck by the light pattern and is effective to discharge the photoreceptor in this area to thereby preclude development of this area and the otherwise subsequent transfer of a developed border or edge to the final copy paper.

BRIEF DESCRIPTION OF THE DRAWINGS

Other objects and advantages of the present invention will become apparent on reading the following detailed description and upon reference to the drawings in which.

DETAILED DESCRIPTION OF THE PREFERRED EMBODIMENT OF THE INVENTION

Figure 1:
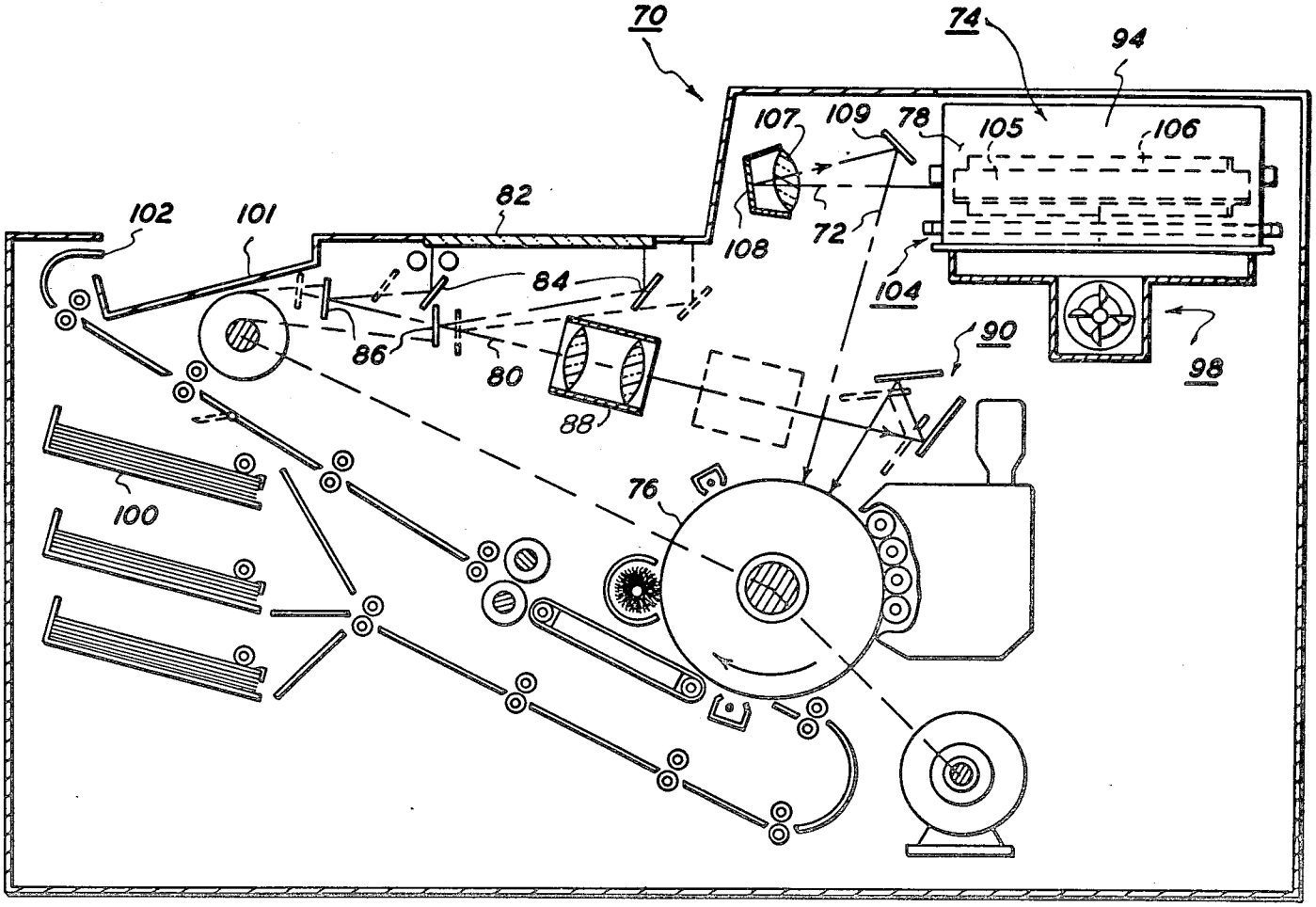
FIG. 1 is a schematic front elevational view of electrophotographic reproducing apparatus incorporating the invention.
Figure 2:
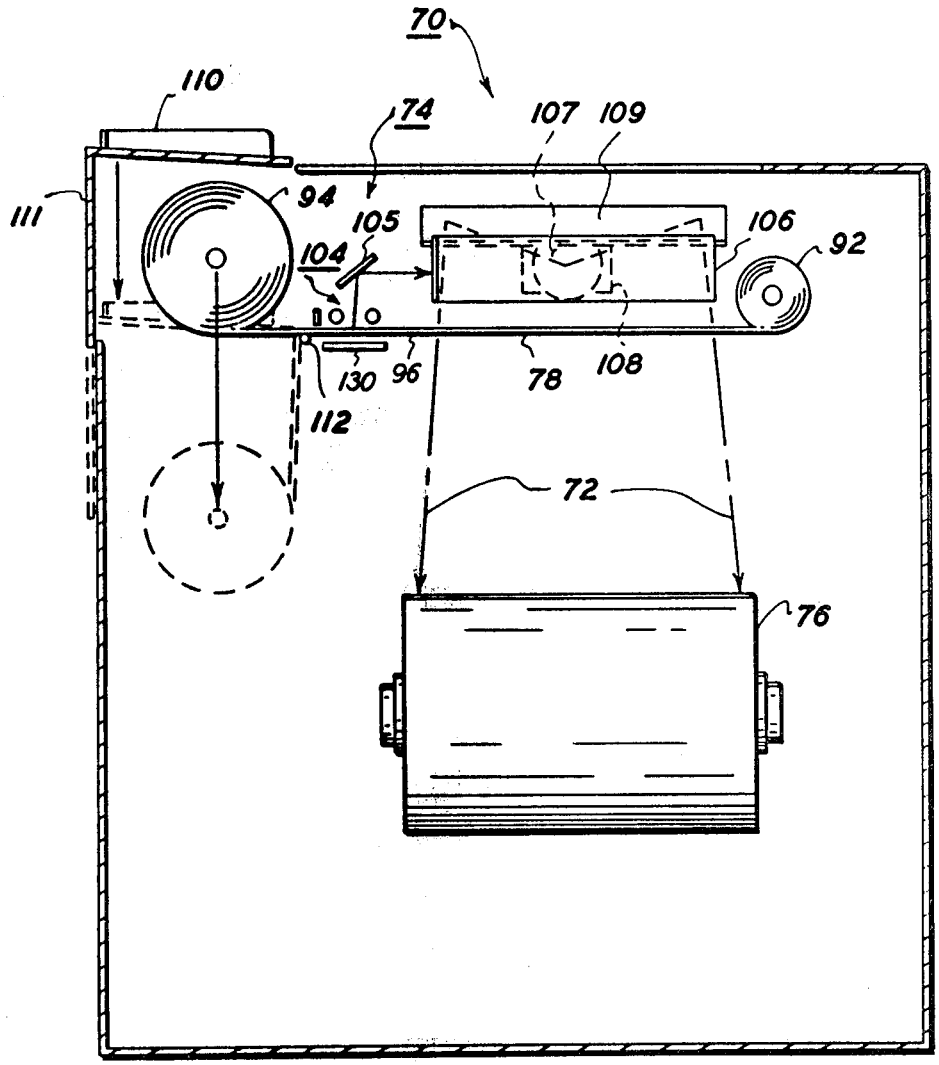
FIG. 2 is a right end view of the apparatus disclosed in FIG. 1.
Figure 3:
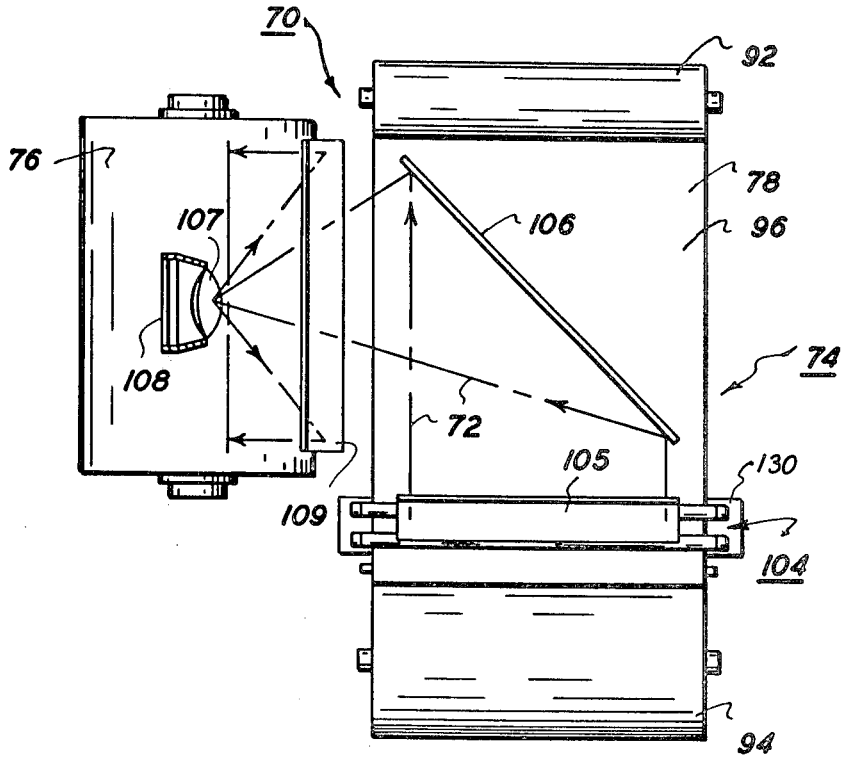
FIG. 3 is a top view of the apparatus disclosed in FIG. 1.

Referring now to FIGS. 1 through 3, it may be seen that these views are respectively, a front view, right end view, and top view of an exemplary embodiment of the invention. The optics path 72 between a web scroll automatic document handling system 74 and a xerographic drum 76 is somewhat complicated because the direction of movement of the web 78 is at right angles to the direction of movement of the surface of the drum. Accordingly, the optics path 72 is shown in the three separate views of FIGS. 1–3 for increased clarity. Referring to FIG. 1, it may be seen that another optics path 80 between a stationary document copying platen 82 and the drum 76 is shown here as a known general type of scanning system. [See U.S. Pat. No. 3,832,057].

A full-speed scanning mirror 84 and half-speed scanning mirror 86 and a lens 88 are shown with alternative dashed positions to indicate their end dwell conditions for a selected variable magnification. The other side of the optics path 80, from the lens unit 88 to the drum 76, includes a two-mirror reflective unit 90. This unit 90 moves as an integral unit to reposition its two mirror elements (note the exemplary dashed position) to change copying magnification. This movement of the mirror unit 90 is along a single axis.

In the automatic document handling unit 74 of FIGS. 1–3, documents are placed on the web 78 and recirculated for precollated output copying between scrolls 92 and 94. However, in this orientation it may be seen that an intermediate section 96 of the web exposed between the two scrolls has its document carrying surface exposed uppermost and is horizontal. Also, the intermediate section 96 extends to one side of the machine at a convenient level. Thus, documents may be conveniently loaded by the operator onto the intermediate web section 96 with gravity assisting in holding the documents onto the web as they are manually positioned thereon. The documents do not have to be manually inserted internally of the machine, i.e. the loading area is exposed and fully accessible.

Figure 4:
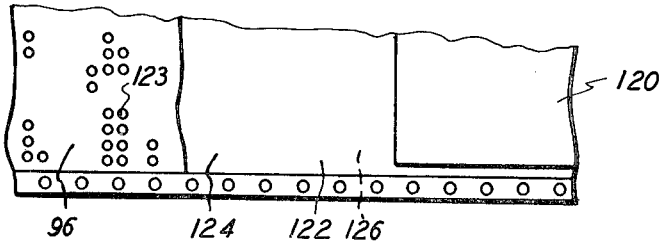
FIG. 4 is a fragmentary view of a web transport belt incorporated in the document transport or handling system of the apparatus shown in FIG. 1.

A vacuum system 98 as shown in FIG. 1 includes a vacuum pump, vacuum chamber, and platen underlying the intermediate section 96 to apply a vacuum through the web to hold documents 120 on the section 96 (See FIG. 4).

Referring now to the xerographic copy processing, general conventional charging, exposing, developing, transferring, and cleaning stations may be seen schematically in FIG. 1. The copy sheets are fed from a duplex copying intermediate storage tray 100, or one of the two blank copy sheet trays below it, through their paper path and into the transfer station with the drum 76 then out through a conventional roll fuser in the paper path to the copy sheet output tray 101. A sheet turnaround 102 is provided just prior to the output tray 101 to provide face-down stacking of the finished copy sheets in the output tray 101.

The optics path 72 of FIGS. 1–3 extends between the illuminated document imaging station 104 and the imaging area on the drum 76. The optics path also extends between an edge fadeout reflector, to be discussed hereinafter, and the imaging area on the drum. The imaging station 104 provides illuminated line scanning of a small area at a time of the document on the intermediate section 96 of the moving web 78. This optics path 72 includes four mirrors and a lens. The document line image from the imaging station 104 is reflected through a first mirror 105 to a second mirror 106 which extends at 45° across the web 78, and then passes through a lens 107 onto a third mirror 108 immediately behind the lens 107. The document image then reflects back through the lens 107 onto a fourth mirror 109 which reflects it onto the drum 76. FIGS. 2 and 3 are simplified views eliminating other components for clarity in showing this optics path 72.

A loading and unloading system for this embodiment 70 is illustrated in FIG. 4. The scroll 94 moves downwardly (as illustrated by the dashed position) to arcuately deflect the web after it passes the imaging station. This allows automatic ejection of documents into a document tray 110 moved into its dashed position as shown. The tray 110 is integral to (on top of) a shroud or housing 111 for the scroll 94. This shroud 111 moves integrally with the scroll 94 axis. When the scroll 94 moves down to its loading/unloading position, the tray 110 moves down with it automatically into a position with one edge of the tray approximately flush with the web 78 at its deflection axis around roller 112. This tray 110 is an automatically positioned catch tray for document unloading, and also provides a continuous document loading tray for sliding documents into the web. An automatic document feeder may be provided there, if desired.

Reference may now be had to the document retaining web, one example of which is illustrated in FIG. 4, as a segment of such a web 96 with one of the plurality of documents 120 on its front or document carrying side 122. The web 96 comprises a substrate of thin, flexible, but substantially non-stretching material which is specularly transmissive (i.e. does not scatter the light as it passes through, as would be the case if the belt contained a diffuse component). A suitable material for such purposes is Mylar which is a trademark product of E. I. du Pont de Nemours and Company. The substrate is highly perforated as indicated at 123 over its major central portion to render air permeable. Its outer edges at each side thereof, may be perforated with suitable, regularly spaced sprocket holes providing for a conventional belt pin or other drive system. However, unperforated edges driven by frictional rollers may also be employed and are presently preferred. The air permeable main portion of the substrate may be covered by a thin layer of high friction material such as transparent rubber 124. This covering layer is on the document carrying side of the web and provides document support. The surface 124 of the web provides a high friction surface relative to the document 120 to prevent document movement or sliding on the surface of the web. The web may be alternatively provided by the substrate without any layer or with a thin coating not covering the apertures but providing a high friction surface. The web is merely exemplary and various other single layer or composite or multi-element porous supports may be utilized.

The side 126 of the web opposite the document handling side, i.e., the backside may be electrically conducting, if desired, for static electricity dissipation, as is known. As the web is wound into its spiral scrolls, the backside of the web of one layer of the scroll abuts the document carried on the adjacent scroll layer frontside. The dissipation of the static charge on the web backside is intended to prevent the document from being electrostatically attracted to the web backside when it is unwound. This electrical conductivity may be provided, for example, by doping or the provision of a layer of graphite, zinc oxide, or other conductive material. The document retaining side of the web may be insulative for certain webs so that electrostatic charges which are produced or reduced thereon can be retained and utilized to provide electrostatic retention forces on the documents to this side of the web. Alternatively, this side may also be conductive.

Since the covering layer is subjected to some contamination by the pulling of air through both the layer and the substrate of the vacuum applied thereto, it will be appreciated that suitable or conventional cleaning means may be provided for the web. One such cleaning means would be to apply positive air pressure to a small segment of the backside of the web during the regular or special recirculations of the web between scrolls, or a vacuum to the frontside, so as to blow particulate materials off the covering layer.

The edge fadeout reflector structure 130 as viewed in FIGS. 1–3, is supported by means (not shown) such that the reflector is spaced away from the side 126 of the document belt in a position to receive illumination from the lamps 104 when the reflector does not completely block the illumination. The reflector serves to focus illumination from the lamps impinging thereon at the aperture of the lens 107.

Figure 5:
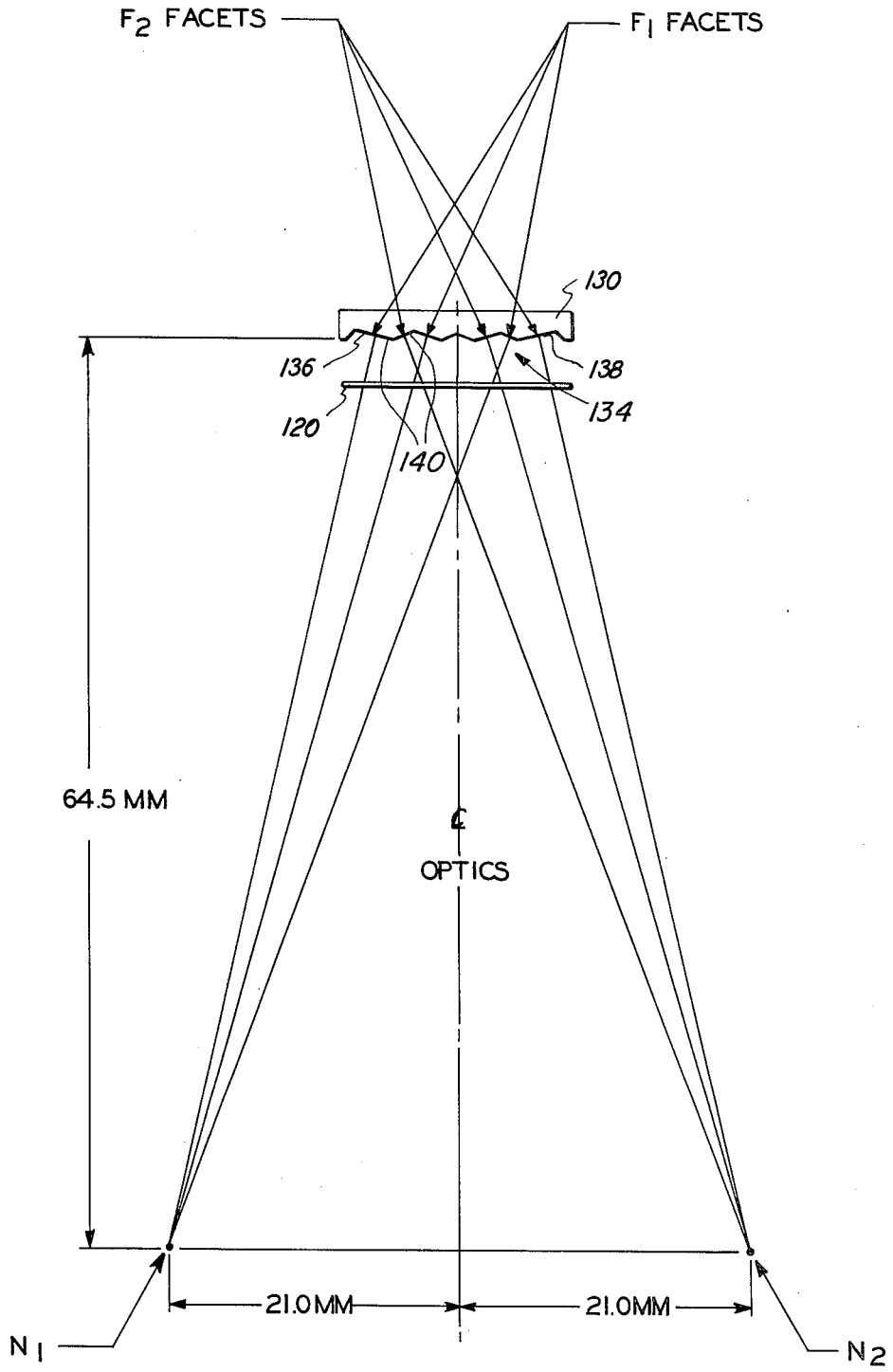
FIG. 5 is a plane view of an edge fadeout reflector incorporated in the optical projection system of the apparatus shown in FIG. 1.

The reflector structure 130 comprises a sheet of material having a substantially planar surface 132 and a multi-faceted surface 134 as illustrated in FIG. 5. Preferably the reflector structure is fabricated from a clear, U. V. stabilized thermoplastic carbonate-linked polymer commercially available under the trade name Lexan Polycarbonate 0107 from the General Electric Company, Pittsfield, Massachusetts. Alternatively, methyl methacrylate may be employed. Other materials may be utilized so long as they are specularly transmissive (i.e. do not appreciably scatter the illumination as it passes therethrough). Stated differently, the material desirably has a relatively small diffuse component.

The multi-faceted surface 134 comprises a plurality of individual planar surfaces or facets 136 and 138 each of which has a coating 140 thereon to thereby render it 0.90 specularly reflective at a wavelength of 590mm. In the preferred method of coating these surfaces 136, aluminum is vacuum deposited thereon. As indicated in FIG. 5, two adjacent surfaces comprise a facet pair. The surface 134 preferably comprises two facet pairs per millimeter. The facets or surfaces 136 and 138 extend in the direction of the lamps 104 or in a direction transverse to the direction of movement of the belt 78.

The facets 136 are disposed at angles with respect to the plane of the belt 78 such that all lines drawn normal or perpendicular thereto (at the intersection thereof with the principal plane) must intersect at a point $N_1$ or pass within 1mm thereof. The facets 138 are also disposed at angles relative to the plane of the belt 78 such that all lines drawn normal thereto (at the intersection thereof with the principal plane) intersect at a point $N_2$ or pass within 1mm thereof. The principal plane of the reflector contains all of the points of intersection of adjacent facets farthest from the planar surface 132. The optical center line (not shown) of the reflector structure 130 bisects the reflector.

In the preferred embodiment of the invention the points $N_1$ and $N_2$ are spaced 64.5mm from the principal plane and the point $N_1$ is spaced 21mm to the left of the optical center line and point $N_2$ is spaced an equal distance to the right as viewed in FIG. 5.

As viewed in FIG. 5, the facet 136 adjacent the lead edge of the document 120 serves to illuminate the edge of the document to thereby prevent a shadow from appearing thereat. Such illumination is projected along the optical path and impinges on the photoreceptor in an area adjacent the area which will be struck by the light pattern reflected by the document. A facet 138 cooperates with the trail edge of the document to effect the core result.

While the invention has been described in conjunction with the preferred embodiment thereof, it will be appreciated that various modifications without departing from the spirit and scope of the invention will be apparent and it is intended that such modifications be covered by the claims attended hereto.

What is claimed is:

1. Image forming apparatus including a stationary illumination source, said apparatus comprising:

belt means for moving a document past said illumination source, said illumination source being disposed adjacent one side of said belt;

means positioned to said one side of said belt for projecting a light pattern reflected from said document along an optical path;

a photoreceptor having a uniform, electrostatically charged portion positioned in said optical path whereby said light pattern impinges upon an area thereof and causes the charged portion to be discharged in accordance with said light pattern; and specular reflector means positioned adjacent the opposite side of said belt to reflect illumination from said source adjacent all the edges of said document along said optical path whereby illumination strikes said uniformly charged portion in an area adjacent the area struck by said light pattern, said illumination being sufficient to discharge said adjacent area, said specular reflector comprising a first set of planar surfaces each disposed at predetermined angles relative to said belt and a second set of planar surfaces each disposed at predetermined angles relative to said belt such that the planar surfaces of said first set are substantially perpendicular to lines which pass through a first reference point and said planar surfaces of said second set are substantially perpendicular to a plurality of lines all of which pass through a second reference point.

2. Apparatus according to claim 1 wherein said belt means is air permeable and wherein vacuum means are provided on the other side of said belt means for retaining said document on the one side of said belt means.

3. Apparatus according to claim 1 wherein said first and second reference points lie in a line which is parallel to the principal plane of said reflector and spaced approximately 64.5 millimeters therefrom and said reference points are disposed to opposite sides of the optical center line of said reflector and spaced from said center line approximately 21 millimeters.

4. Apparatus according to claim 3 wherein each specular surface is at least 0.90 specular at a wavelength of 590mm.

5. Apparatus according to claim 4 wherein adjacent planar surfaces form a facet pair and the spatial frequency of the facet pairs is two facet pairs per millimeter.

* * * * *